United States Patent [19]

Regnier et al.

[11] Patent Number: 4,713,013

[45] Date of Patent: Dec. 15, 1987

[54] COMPLIANT HIGH DENSITY EDGE CARD CONNECTOR WITH CONTACT LOCATING FEATURES

[75] Inventors: Kent E. Regnier, Lombard; Thomas C. Hoover, Lisle; Alan S. Walse, LaGrange, all of Ill.

[73] Assignee: Molex Incorporated, Lisle, Ill.

[21] Appl. No.: 9,415

[22] Filed: Jan. 30, 1987

[51] Int. Cl.[4] ..... H01R 9/09

[52] U.S. Cl. ..... 439/62; 29/842; 439/326; 439/328; 439/633

[58] Field of Search ..... 339/17 L, 17 M, 17 LC, 339/17 LM, 75 MP, 176 MP, 184 M, 186 M; 439/62, 326–328, 629–637; 29/842

[56] References Cited

U.S. PATENT DOCUMENTS

| | | | |
|---|---|---|---|
| 3,533,045 | 10/1970 | Henschen | 339/176 MP |
| 3,566,340 | 2/1971 | Jayne et al. | 339/186 M |
| 3,848,952 | 11/1974 | Tighe, Jr. | 339/176 MP |
| 4,136,917 | 1/1979 | Then et al. | 339/176 MP |
| 4,575,172 | 3/1986 | Walse et al. | 339/176 MP |
| 4,577,922 | 3/1986 | Stipanuk | 339/176 MP |

*Primary Examiner*—John McQuade

*Attorney, Agent, or Firm*—John W. Cornell; Louis A. Hecht

[57] ABSTRACT

A connector arrangement for electrically connecting circuit elements disposed on two printed circuit boards and spaced apart at centerlines of about 0.050 of an inch or less is described which includes a pitch controlling contact locator cooperating between the mating edge of an edge card and the connector housing. The pitch controlling contact locator includes a resilient supported spring member disposed in the connector cavity generally at the midpoint of the terminal array which is resilient in a vertical direction and substantially rigid in a horizontal direction. It further includes a mating cutout disposed in the mating edge generally at the midpoint of an array of contact pads which is adapted to engage the spring member with two points of contact when the edge card is inserted into the connector cavity. The pitch controlling contact locator effectively reduces lateral mating misalignments introduced in the arrangement by stacking of manufacturing tolerances and vertical mating misalignments caused by mother board warpage introduced by exposure to high temperature wave soldering processing.

10 Claims, 10 Drawing Figures

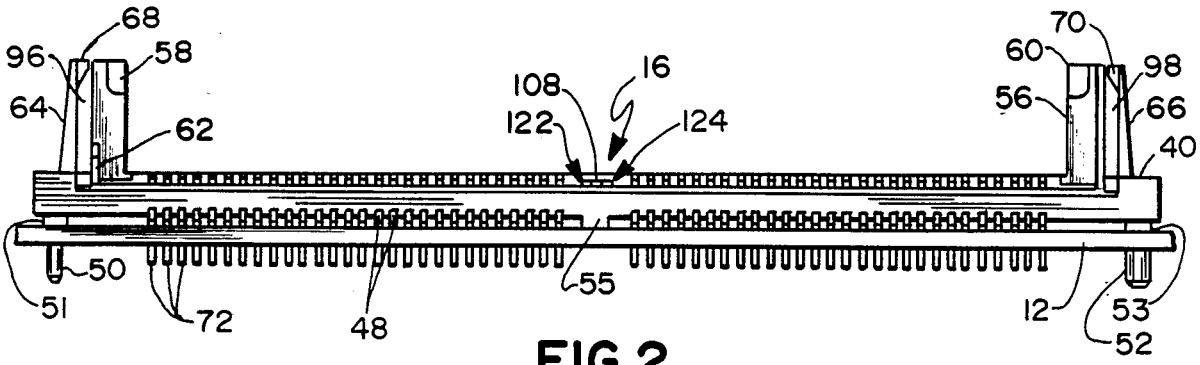
FIG.2
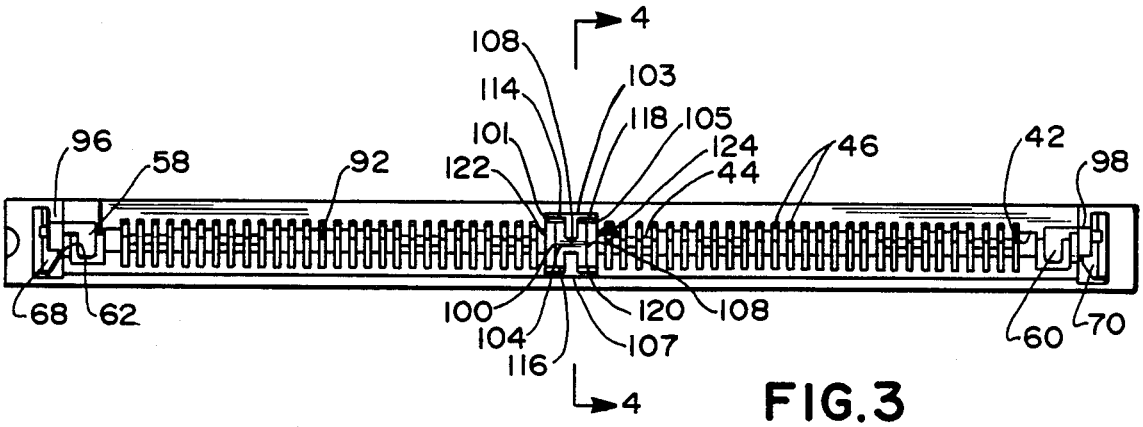
FIG.3
FIG.6
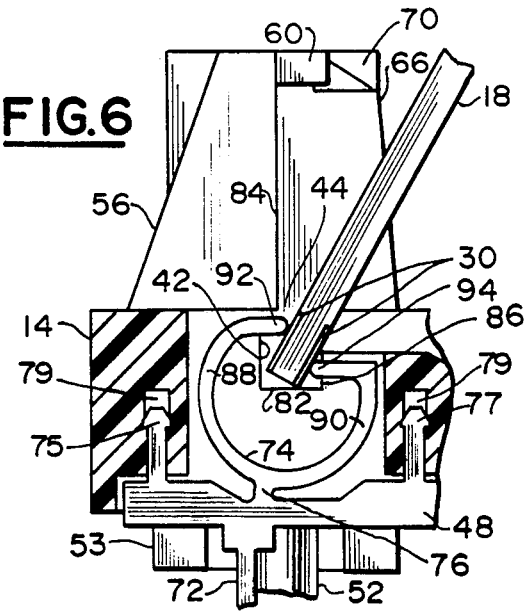
FIG.7
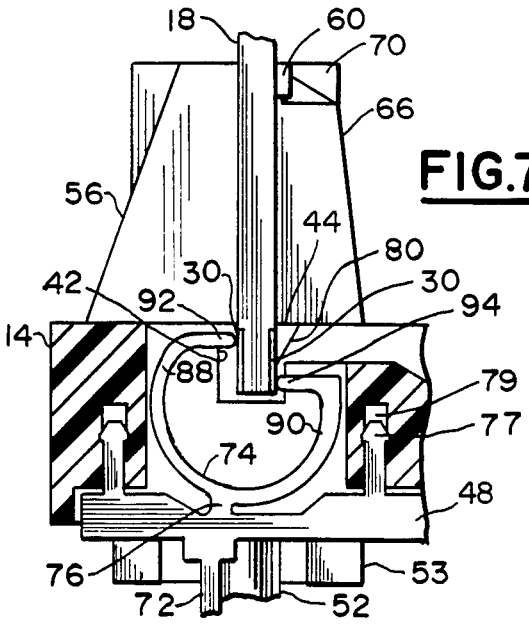

COMPLIANT HIGH DENSITY EDGE CARD CONNECTOR WITH CONTACT LOCATING FEATURES

The present invention relates to new and improved high density multi-circuit electrical connectors of the type adapted for making edge card connections between printed circuit boards. More particularly, it relates to an ultra-low pitch edge card connector including pitch controlling contact locator means cooperating between the mating edge of an edge card and a modified dielectric connector housing to provide a connector arrangement which substantially reduces or eliminates mating misalignments introduced by stacking of dimensional tolerances and circuit board warpage.

Multi-circuit electrical connectors of the type adapted for mounting on a printed circuit board typically include a plurality of electrical terminals disposed within a unitary dielectric housing. In these arrangements the housing typically surrounds portions of the terminals immediately adjacent the printed circuit board to provide rigid support for the terminals.

Low insertion force embodiments of these multi-circuit connectors generally provide for the edge card to be inserted into the connector housing in a first position and then rotated into a final position make electrical contact with spring terminals mounted in the housing. Illustrative examples of low insertion force type edge card connectors are described in U.S. Pat. Nos. 3,848,952 and 4,136,917.

An improved low insertion force multi-circuit connector is described in U.S. Pat. No. 4,575,172, assigned to the same assignee as the present invention. The connector described in this patent includes rockably mounted C-shaped resilient spring contacts mounted in a housing including first and second integrally formed limit surfaces. The rockably mounted C-shaped contacts are substantially compliant to edge card warpages along the mating edge and the internal limit surfaces of the connector housing provide important anti-overstress features for the contacts. Together these features provide improved electrical connections and reliability with the connector.

In accordance with recent advances in the electronics art, there is a decided trend toward increasing circuit density, and concurrently, the desire for increased connector miniaturization. In this modern environment, difficulties in maintaining the pitch or centerline spacing of the terminals have been encountered with increasing connector miniaturization. Difficulties in pitch control arise because of several factors including the inherent physical properties of the dielectric materials from which connector housings are made and the response of these materials to environmental and processing conditions encountered by parts molded from them during assembly operations and in use.

More particularly, it is well known that many plastics tend to swell upon exposure to high humidity. Another common problem is that extrusion and molding operations introduce thermal stresses in modern plastics, which can cause molded parts to warp on cooling after the molding cycle. Moreover, even perfectly molded and cooled products may still have internal thermal stresses present, which upon subsequent heating and cooling steps in further processing, will tend to relax, causing warpage in the part, thereby introducing errors in the centerline spacing of terminal cavities formed in the connector housings.

By way of illustration, it is common practice to assemble a connector housing with terminals and mount them onto mother printed circuit boards. Thereafter, the terminals are electrically connected to circuits on the mother board in a subsequent wave-soldering operation. Wave soldering is performed at bath temperatures above the melting point of solder, i.e. generally between 364 degrees and 600 degrees F. More commonly, bath temperatures of between 500 degrees and 550 degrees F. are used, with a wave contact time of from about 3 to about 10 seconds. The molten solder is washed against the underside of the mother board to make the necessary electrical connections, but in the process, localized indirect heating of the mother board and the mounted connector housing also occurs. This indirect heating raises the temperature of the assembly to a point that is high enough to relax the stored internal stresses of the parts on cooling which is most often expressed as warpage in the parts. The problem is compounded further by the fact that during wave soldering, the temperature at the underside of the mother board may be as high as 500 degrees F while at the upper surface the temperature may be between about 250 degrees to 350 degrees F. This sets up a large temperature differential across the part or mother board itself introducing new thermal stresses in the part, which are relieved or expressed as warpage on cooling after the wave soldering operation.

Other factors may contribute to warpage of the mounted connector/mother board assembly in connection with the wave soldering operations. External forces placed on the assembly before wave soldering, such as tight lateral clamping can introduce warpage. Incomplete curing of the composition of the mother board may also cause warpage problems. In this connection, the temperatures of wave soldering can reactivate the curing mechanism in the substrate composition which can cause variations in the configuration of the substrate on final cooling. Mismatched thermals or thermal properties between the mother board substrate composition and the connector molding composition such as different thermal expansion coefficients can also introduce stresses which are expressed as warpage in the cooled assembly. Finally, every thermal excursion experienced by each of the component parts from extrusion and molding to post-mold bake cycles and wave soldering, all tend to introduce stresses, errors and warpage. Even miniscule variations in configurations and dimensions in the components caused by these factors are extremely important in achieving good reliable electrical connections in todays more miniaturized and higher density connection environments.

In prior art edge card connector arrangements, wherein the centerline spacing of terminals and circuits is on the order of 0.100 inch or higher, these factors are relatively insignificant. In modern, high density arrangements, however, wherein it is now desired to space terminals and circuits at an ultra-low pitch on the order to 0.050 inch and even as low as 0.025 inch, these factors become critical to the success or failure of the connector arrangement.

Earlier efforts to overcome some of these difficulties and provide a more miniaturized and higher density connector arrangements have included the development of a laminated connector assembly as described in commonly assigned U.S. Pat. No. 4,577,922. The laminated assembly disclosed in this patent, instead of relying upon a dielectric housing to support and space connector terminals, provides a linear array of stamped metallic terminals, each having a dielectric coating on at least one side of the terminal. In accordance with this patent, the free-standing terminals are inserted into a printed circuit board, for example, to provide a self supporting terminal array defining an edge card socket, with the intermediate dielectric coatings electrically isolating the individual terminals from one another. The disclosed laminated connector arrangement provides several advantages in that the need for a housing is avoided and closer terminal spacing can be provided by this arrangement.

Electrical component manufacturers continue to desire further miniaturization and increased circuit density from interconnection manufacturers and difficulties in pitch control with the laminated arrangements arise, from time to time. More particularly, miniscule variations in the thickness of the metal stock, as well as deviations in the applied dielectric coating thickness, i.e., inherent manufacturing tolerances for these materials, are now more and more significant with increasing density. As the laminated array is formed, the tolerances present in the individual parts can stack up or accumulate, with the net effect that some of the terminals at one side of the array become unmateably offset from the circuits with which they are intended to mate. In this manner, minor deviations on the order of only thousandths of an inch are observed to add up to hundredths of an inch, which in a connector arrangement having a circuit spacing of 0.050 inch, are sufficient in some cases to introduce major mating misalignment for some of the terminals.

One solution to this pitch control problem sometimes encountered with low pitch laminated connector arrangements is described in commonly assigned copending application, Ser. No. 818,160, filed Jan. 13, 1986. In accordance with this application, a connector arrangement providing improved pitch control in closely-spaced laminated terminals is provided by interleafing the terminals with a pitch-controlling amount of a resilient compressible dielectric material. The compressible terminal array thus formed is compressed end-to-end in an accordian-like fashion and inserted in a foreshortened cavity in a connector housing, which retains the compressed array in a compressed state. This arrangement does not permit inherent manufacturing tolerances to add up along the terminal array. Instead, thickness tolerances will be absorbed in effect by locally compressing the interleaf layers to a greater or lesser extent. The foreshortened cavity length in the housing is fixed and therefore instead of cumulatively stacking individual tolerances in the terminal array, these minor deviations are averaged by this arrangement. The resulting low pitch connector arrangement exhibits more reliable pitch control and mateability in high density connector arrangements.

Although the above-mentioned application provides an excellent pitch controlling feature for high density laminated connectors, still other connnector types are desired or required. Electronic component manufacturers for example, desire to have a pre-loaded, pitch-controlled high density connector adapted for single step robotic placement in fully automated assembly plants. In other applications, a dielectric connector housing may be needed. Moreover, in modern component assemblies it is now desired to provide higher density circuit elements wherein center line spacing between circuits is on the order of 0.050 inch and preferably is as low as 0.025 inch. In this regard, other miniaturized, high density connector designs are still desirable or required.

SUMMARY OF THE INVENTION

In order to meet the demand for high density edge card connectors, it is an object of the present invention to provide a new and improved edge card connector arrangement including pitch controlling features to provide improved mateability between connector terminals and circuit elements on printed circuit boards.

It is another object of the present invention to provide a new and improved edge card connector arrangement in which mating misalignments introduced by dimensional tolerances and circuit board warpage are substantially reduced.

It is a further object of the present invention to provide a substantially compliant ultra-low pitch edge card connector for use with modern high density circuit boards exhibiting improved mateability and reliability.

These and other objects are accomplished in accordance with the present invention by providing an arrangement for electrically connecting closely-spaced circuit elements between two printed circuit boards, said arrangement including:

a first printed circuit board; and a second printed circuit board having a mating edge and a surface with a linear array of aligned contact pads adjacent said edge;

a connector including an elongated dielectric housing with a cavity formed along its length with an opening for receiving said second printed circuit board mating edge and a plurality of terminals mounted in the housing to form a closely-spaced linear terminal array, each terminal adapted to engage a contact pad when the second printed circuit board is inserted into the cavity through said opening and means for mounting said connector to said first printed circuit board; the improvement comprising:

a pitch controlling locating means cooperating between said mating edge and said connector, said locating means including a resilient supported spring member disposed in said connector cavity generally at the midpoint of said terminal array, said spring member being resilient in a vertical direction and substantially rigid in a horizontal direction; and a mating cut out disposed in said mating edge generally at the midpoint of the array of contact pads and adapted to engage said spring member with two points of contact when the second printed circuit board is inserted into said cavity whereby a connector arrangement exhibiting improved centerline mating between the closely spaced circuits on the printed circuit boards and the terminals is provided.

In accordance with the present invention the pitch controlling locating means provides improved reliability in centerline mating, firstly, by effectively bisecting the terminal array into two halves. This bisection in turn cuts the possible cumulative stacking of manufacturing tolerances which ordinarily promote misalignment in half. The locating means cooperates between the connector housing and the edge card, to provide this first pitch controlling compliance feature for manufacturing tolerances. Secondly, the pitch controlling locating means also includes the resilient spring member disposed in the connector cavity which is resilient in a vertical direction only and rigid in a horizontal side to side direction. This unique feature promotes improved centerline mating by providing compliance between the edge card mating edge and any warpages induced in the mother board or connector housing brought on by wave soldering operations and temperatures. The spring member deflects downwardly as the edge card is inserted to its mated position. A portion of the deflection range compensates for warpage in the event of bowing in the connector housing or mother board to ensure good electrical contact with the contact pads on the edge card.

The pitch controlling locating means effectively corrects for dimensional deviations introduced into the arrangement by modern manufacturing methods or by modern handling operations. The present invention provides a reliable edge card connector which may be used in ultra-low pitch applications wherein circuit elements are closely spaced on the order of about 0.050 inch centerline spacing and below, even as low as 0.025 inch spacing with high compliance.

The present invention also provides a method for providing improved centerline mating between terminals and contact pads in a high density edge card connector arrangement including a linear array of closely-spaced terminals in a connector housing adapted to mate with a corresponding linear array of closely-spaced contact pads disposed on a surface of an edge card adjacent a mating edge, said method comprising:

(a) providing a pitch-controlling, contact locator generally at the midpoint of said linear terminal array, said contact locator comprising a resilient supported spring member being resilient in a vertical direction and substantially rigid in a horizontal direction;

(b) providing a mating cut-out in the mating edge generally at the midpoint of the array contact pads, said cut-out being adapted to engage said spring member with two points of contact;

(c) positioning the edge card in said connector so that the mating cut-out engages said spring member with two points of contact and deflects the spring member downwardly to permit the contact pads to electrically engage said terminals; and (d) retaining said edge card in mating engagement with said connector.

Other objects and advantages of the present invention will become apparent from the following Detailed Description taken in conjunction with the drawings in which:

BRIEF DESCRIPTION OF THE DRAWINGS

FIG. 2 is a side elevation view of the new and improved ultra low pitch connector of the present invention mounted on a high density first printed circuit board.

FIG. 3 is a top plan view of the new and improved ultra low pitch connector of the present invention.

FIGS. 6–7 are fragmentary cross sectional views depicting the motions for engaging an edge card into the new and improved connector arrangement in accordance with the preferred embodiment of the present invention.

DETAILED DESCRIPTION OF THE PREFERRED EMBODIMENT

Figure 1:
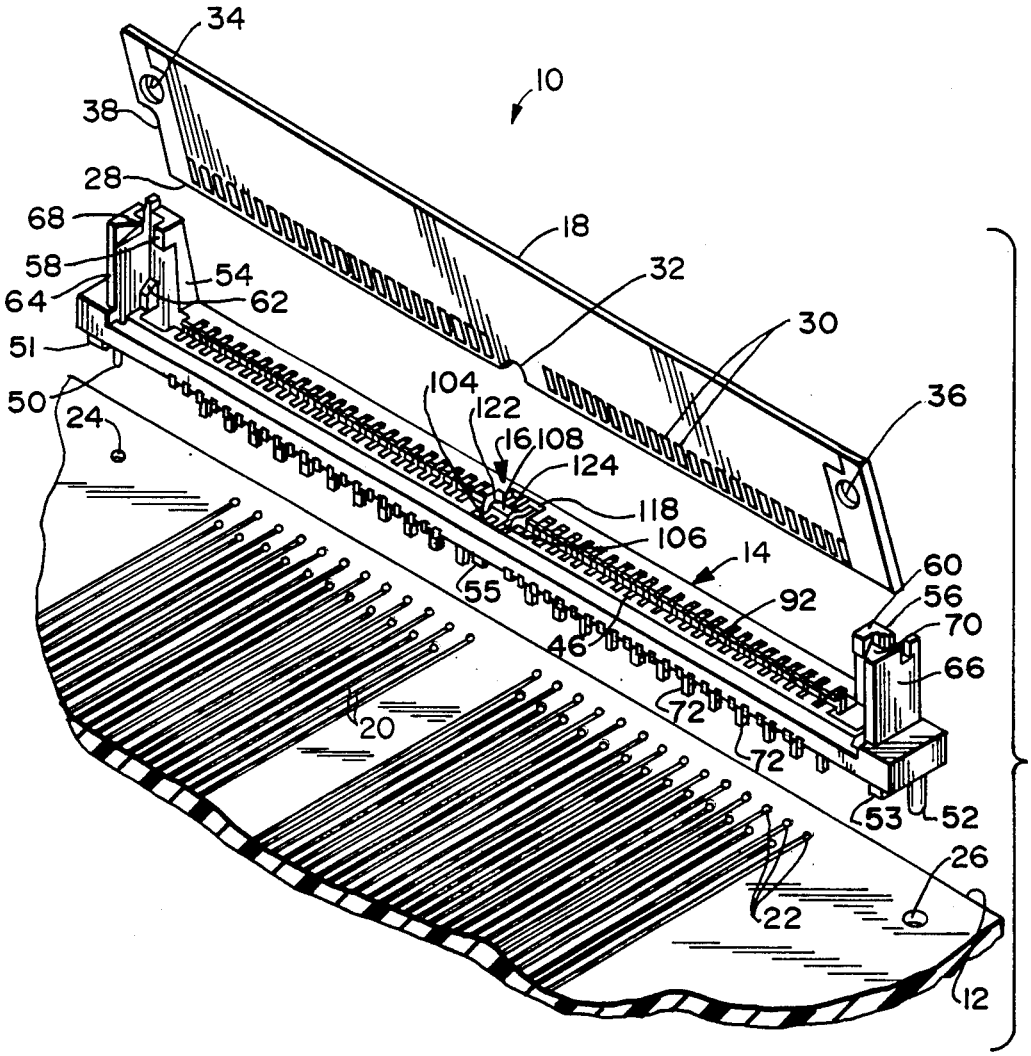
FIG. 1 is an exploded perspective view of the new and improved ultra low pitch connector arrangement of the present invention.

Referring to FIG. 1 the new and improved ultra-low pitch connector arrangement of the present invention, generally referred to by the reference numeral 10, is shown. Connector arrangement 10 includes a first high density printed circuit board or mother board 12; the new and improved ultra-low pitch connector 14 including contact locator means 16 disposed generally at the midpoint of connector 14 and a second high density printed circuit board or edge card 18. As used herein and in the claims the term ultra-low pitch refers to centerline spacings either between adjacent terminals or adjacent circuits in connector arrangement 10 which are generally less than about 0.100 inch apart, preferably on the order of 0.050 inch apart and especially preferably on the order of 0.025 inch apart.

More particularly, mother board 12 is a high density printed circuit board including a plurality of closely spaced circuit elements 20 set at ultra-low pitch on at least one major surface thereof. In the preferred embodiment shown in FIG. 1, mother board 12 comprises a double sided, high density printed circuit board having ultra low pitch circuit elements 20 defined on each of the major surfaces thereof interconnected by plated through-holes 22. Plated through-holes 22 are on a corresponding ultra-low pitch spacing and preferably as shown in FIG. 1 adjacent through-holes 22 are staggered with respect to one another to provide increased through hole land area. Staggering also permits larger hole diameters to be used to facilitate robotic insertion operations.

Mother board 12 also includes mounting apertures 24, 26 for securing connector 14 in position on mother board 12. Care should be taken in preparing mother board 12 that the drilling of through holes 22 and mounting apertures 24 and 26 all be performed at the same time after a single placement and positioning step. This will avoid introducing errors in hole placement by having to realign a mother board 12 which has already been provided with through-holes 22 for subsequent drilling of mounting apertures 24 and 26. As it now should be appreciated, errors of thousandths of an inch become very significant in ultra-low pitch applications, so all handling and positioning steps should be kept to a minimum. Double sided mother boards are preferred to provide redundancy for enhanced electrical reliability.

Connector arrangement 10 also includes a second printed circuit board or edge card 18. Edge card 18 includes a mating edge 28 and a surface with a linear array of contact pads 30 disposed in alignment at ultra-low pitch adjacent mating edge 28. A mating cutout 32 of semicircular configuration is provided generally at the midpoint of the mating edge 28. Cutout 32 is effectively positioned to bisect the linear array of contact pads 30 into two equal parts. In the preferred embodiment shown in FIG. 1, edge card 18 comprises a high density double sided edge card having closely spaced circuit elements disposed on both major surfaces of the card and terminating in an ultra-low pitch array of contact pads 30 disposed on the upper and lower surfaces adjacent the mating edge 28. Contact redundancy is thereby provided for improved electrical reliability.

Edge card 18 additionally comprises mounting apertures 34, 36 which are adapted to cooperate with connector 14 to further locate edge card 18 in mated relationship with the connector housing 14. In the preferred embodiment shown in FIG. 1 edge card 18 additionally includes a polarizing cutout 38. Polarizing cutout 38 is adapted to cooperate with connector 14 to provide oriented insertion and mating of edge card 18 in connector 14.

Connector arrangement 10 further comprises the new and improved ultra-low pitch connector 14. As shown in FIGS. 1–7, connector 14 includes an elongate unitary dielectric housing 40 having a cavity 42 formed along its length with an opening 44 for receiving mating edge 28 of edge card 18. A plurality of transverse closely spaced compartments 46 are disposed along cavity 42 each one being adapted to receive a terminal 48. Housing 40 is molded to receive terminals 48 at an ultra-low centerline spacing or pitch.

In the preferred embodiment shown in FIGS. 1–3 and 6–7, housing 40 is further provided with depending mounting bosses 50 and 52 extending from the lower surface of housing 40 adjacent the opposed ends thereof. Mounting bosses 50 and 52 are adapted to be received within mounting apertures 24 and 26 in mother board 12 to mount connector 14 to the mother board. In the preferred embodiment shown in FIGS. 1 and 2, polarization of mounting orientation of connector 14 on board 12 is accomplished by providing mounting bosses and corresponding mounting apertures having different diameters. As shown, mounting aperture 24 has a smaller diameter than aperture 26. Mounting boss 50 has a smaller diameter than mounting boss 52. In this manner, dedicated orientation of connector mounting can be provided. Additionally preferrably, mounting bosses 50 and 52 are provided with board stand-off portions 51 and 53, respectively, to facilitate flushing of the connector arrangement after wave soldering. Connector housing 40 may be provided with additional stand-off projections for the same purpose such as the centralized stand-off projections 55.

Connector housing 40 also includes a pair of upstanding mounting posts 54 and 56 disposed adjacent the opposed ends of housing 40 on one side of cavity 42. Each of mounting posts 54 and 56 are provided with forwardly directed mounting projections 58 and 60 which extend in a cantilevered manner away from the upper ends of posts 54 and 56, respectively, to a point overlaying cavity 42. Mounting projections 58 and 60 are adapted to cooperate with mounting apertures 34 and 36 in edge card 18 to further position and retain edge card 18 in proper alignment for mating.

Mounting post 54 is additionally provided with a keying projection 62 extending in the same direction as mounting projection 58 but from the base of mounting post 54 immediately above cavity 42. Keying projection 62 is adapted to cooperate with polarizing cutout 38 on edge card 18 to limit the orientation of permitted insertion of edge card 18 within connector cavity 42. Polarizing mating is a more important feature in applications wherein double sided edge cards or redundant contact terminals 50 are not or cannot be used.

Connector housing 40 further includes a pair of upstanding resilient or yieldable latch posts 64 and 66 disposed at the opposed ends of cavity 42 adjacent mounting posts 54 and 56, respectively. Each latch post 64 and 66 includes an integrally formed resilient or yieldable latch projection 68 and 70 formed at the upper ends thereof, respectively, for yieldably retaining edge card 18 in mated relationship to connector 14.

Ultra-low pitch connector 14 also includes terminals 48 mounted in each of compartments 46 in housing 40 to form an ultra-low pitch linear terminal array. Terminals 48 can be formed of any suitable resilient electrically conductive metallic material, such as for example, a strip of beryllium copper having a thickness of approximately 0.015 inch. In the preferred embodiment shown in FIGS. 1–3, 6–7 and 8A, terminals 48 are spring contact terminals, each having a solder tail 72 at one end adapted to be received in a plated through-hole 22 in mother board 12 to electrically connect with one of the circuits defined on mother board 12. At the opposed end of terminal 48, a double beamed C-shaped spring contact portion 74 is provided, each beam or arm of the contact portion 74 being adapted to electrically engage each one of a pair of vertically aligned contact pads 30 disposed on each surface adjacent mating edge 28 and corresponding to a single edge card circuit. Intermediate the contact portions 72 and 74 is a rocker arm mounting portion 76. Terminals 48 are provided with mounting barbs 75 and 77 adapted to engage stepped terminal mounting passages 79 provided in housing 40 to firmly seat the terminals 48 therein. Other terminal configurations such as spring contact solder tail terminal 78 shown in FIG. 8C. could also be used. Generally, terminals 48 are electrically insulated from each other, but they may be commoned as desired by conventional commoning strips as will be apparent to those skilled in this art, joining adjacent rocker arm portions 76, or solder tails 72 as desired.

Connector 14 is designed to provide zero or low insertion force mating between terminals 48 and contact pads 30 on edge card 18. More particularly, as shown in FIGS. 6–7, opening 44 to cavity 42 includes an elongated inclined insertion surface 80, a bottom surface 82, and an inwardly protruding shoulder stop or limit surface 84. A vertically extending surface 86 is provided between the inclined surface 80 and the bottom surface 82.

Each spring contact terminal 48 has a rounded continuously curved generally C-shaped portion 74 with two opposed arcuate beam members 88 and 90 having free ends which comprise integrally formed spaced apart resilient contacting portions 92 and 94 each for respectively contacting conductive pads 30 disposed along opposite sides of mating edge 28 of edge card 18. A rocker arm 76 mounted in housing 40 and extending from the C-shaped portion 74 provides the sole support for portion 74 when the printed circuit board printed edge card 18 is mounted therein. By disposing the contacting portions 92 and 94 at different elevations within compartment 46 in cavity 42 corresponding respectively to the elevational dispositions of the surface 86 and of the surface 84, edge card 18 may be inserted at an angle as shown in FIG. 6 and then rotated to its final or contact position as shown in FIG. 7. The insertion angle or orientation of edge card 18 is parallel to the angle or orientation of the inclined surface 80. In this manner low or zero insertion force is required to insert mating edge 28 into cavity 42, thereby minimizing undesireable wear on the conductive strips or pads 30 and spring contacts 74. The inclined surface 80 may be used as a guide surface for the insertion of printed edge card 18.

After its insertion, the printed edge card 18 may be pivoted or rotated about the contacted portion 94 or surface 86 until it assumes a final contact position shown in FIG. 7. In which position mating edge 28 is resiliently maintained above the bottom surface 82 and mounting apertures 34, 36 engage the mounting projections 58 and 60 on mounting posts 54 and 56 in a manner to be more particularly described hereinafter. Edge card 18 is retained by latch members 68 and 70 on posts 64 and 66. In the final or contact position, contact portions 92 and 94 are resiliently deflected outwardly from the center of the compartment 46 by their respective engagements with conductive pads 30. The configuration of spring terminals 48 and the contacting portions 74 provide relatively high contact force between the contacting portion 92 and 94 and conductive pads 30. The C-shaped portion 74 is pivotably or rockably mounted on leg 76 to maintain the high contact force despite any warpage or other similar misalignment of mating edge 28. Any extraordinary increase in pressure applied to one contacting portion 92 or 94 causes the C-shaped portion 74 to rock or pivot about the leg 76, maintaining substantially equalized predetermined contact forces on both of contacting portions 92 and 94. Thus, each beam member 88 and 90 must be free to move without contacting the walls defined by the interior surfaces of the compartments 46 in housing member 40. However, as will be appreciated by those skilled in this art, some antioverstress means for the beam members 88 and 90 must be provided.

Accordingly, deflection of contacting portion 92 disposed at the same elevation and in an overlying relationship with surface 84 and the resultant stress imparted to the spring contact 74 is limited by stop or limit surface 84. That is, contact portion 92 cannot be deflected beyond the inwardly extending limit surface 84 since limit surface 84 will simply engage the edge of edge card 18 to limit its pivotable or rotational movement within cavity 42. Anti-overstress is also provided by stop surfaces 96 and 98 in latch posts 64, 66, respectively, as well as, by vertical surface 86.

Connector 14 has so far been described in general terms and in many general respects possesses a number of features very similar to the connector described and claimed in the abovementioned U.S. Pat. No. 4,575,172. Further details regarding these general properties including the low insertion force and anti-overstress features can be obtained from this patent, the teachings of which are expressly incorporated herein by reference.

Turning now to the unique features of connector 14 which render it particularly well suited for making ultra-low pitch interconnections between printed circuit boards, connector 14 includes a contact locator means 16 disposed intermediate the length thereof generally at the mid point of the linear array of terminals 48. Pitch controlling contact locator means 16 comprises a supported spring member 100 which is integrally molded and unitary with the housing member 40 and defined or disposed within an enlarged rectangular recessed area 102 defined four opposed vertical side walls 101, 103, 105 and 107.

Figure 4:
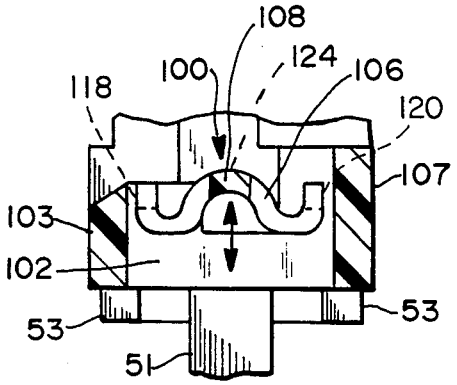
FIG. 4 is an enlarged elevational cross sectional view of the pitch-controlled contact locator means of the present invention taken along the lines 4—4 of FIG. 3.
Figure 5:
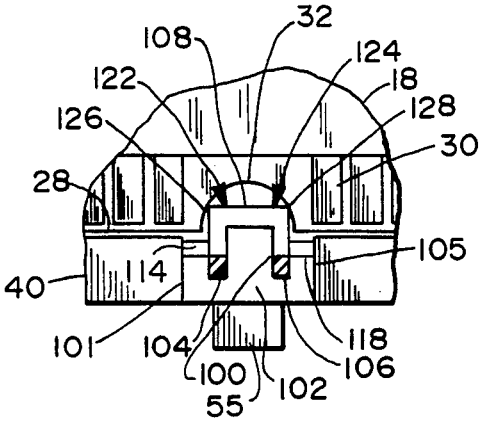
FIG. 5 is a enlarged elevation view, partially in section, showing mating engagement of the new and improved pitch controlling locating means of the present invention.

More particularly, as best shown in FIGS. 3–5, supported spring member 100 is of an H-spring configuration including two spaced leg members 104 and 106, mechanically interconnected by a cross bar 108. H-spring 100 is integrally formed with connector housing 40 and extends in a transverse direction across housing cavity 42. Each of the opposed ends of legs 104 and 106 extend from a point intermediate the height of vertical side walls 103 and 107 and are mechanically joined to side walls 101 and 105, respectively, by means of lateral connecting bars 114, 116, 118 and 120. Each leg member 104 and 106 includes a pair of concave portions at its opposed ends adjacent bars 114, 116, 118 and 120 joined by an intermediate convex portion with the intersection of cross bar 108 at regions 122 and 124 forming the apex of the convex portion. Supported spring 100 is thereby molded to define a smoothly curved, upwardly biased but downwardly deflectable H-spring. Supported spring member 100 is molded such that the cross bar 108 and raised regions 122 and 124 are elevated slightly with respect to opening 44 in cavity as shown in FIG. 2. Lateral connecting bars 114–120 mount spring 100 in such manner that it is substantially rigid in a horizontal direction.

Supported spring 100 is adapted to cooperate with the mating cutout 32 in the mating edge 28 of edge card 18 to provide enhanced reliable pitch controlled centerline to centerline mating for a corresponding pair of contacts spaced at ultra-low pitch. More particularly, during insertion of edge card 18 into connector 14, cutout 32 engages raised portions 108, 122 and 124 on spring 100 with two points of contact 126 and 128 as illustrated in FIG. 5. The two point contact assures positive positioning in a horizontal or side-to-side direction for mating edge 28 with respect to housing cavity 42.

Moreover, placement of this positive contact point at the mid-point of the connector 14 and edge card 18 provides an extremely important reference point in manufacture for pitch-controlled mating of corresponding contacts each disposed in an ultra-low pitch linear array. Central placement of the contact locator means 16 comprising spring member 100 and cutout 32 effectively divides each longer linear array into two shorter ultra-low pitch linear arrays. This automatically cuts the maximum possible mating misalignment which can be introduced by the cumulative stacking of manufacturing tolerances in half, for the connector. This is because the maximum possible errors which can be caused by stacking of tolerances is directly related to the length of the array over which the individual tolerances can be added and expressed. In this sense, contact locator means 16 is pitch-controlling.

As edge card 18 is further inserted through opening 44 in cavity 42, spring 100 is deflected downwardly until edge card 18 is pivoted into mated electrical contact position. The ability of spring member 100 to be deflected in a vertical direction but substantially not a horizontal direction is also an important aspect of the ultra-low pitch connector 14. More particularly, a second important cause of contact misalignment in making an ultra-low pitch edge card connection is warpage, especially bowing, of the mother board 12 following wave soldering operations to electrically connect the solder tails 72 of terminals 48 to circuits 20 on mother board 12. Bowing of mother board 12 can cause variations in the relative heights of contacts 92 and 94 within connector 14. In most cases where bowing is encountered, the mother board usually bows upwardly in the middle portion of the mother board. This warpage causes contact portions 92 and 94 on terminals 48 disposed toward the center of the connector 14 to be relatively higher and offset from those on terminals located adjacent the ends of connector cavity 42. As can be appreciated, in a different connector arrangement where this warpage has occurred, insertion of the edge card into the connector to a depth sufficient to contact terminals and pads in the central portion of the connector may not be sufficient to provide terminal to pad contact at the end portions. Similarly, full insertion of the edge card into the connector to a depth sufficient to provide good terminal to pad contact at the ends of the connector may cause the contact points on centrally located terminals to overshoot the contact pads located in the central section of the edge card. In either case electrical connection for some of the circuits is lost.

The new and improved connector arrangement 10 of this invention drastically reduces the probability of a failure to connect all circuits from occurring, even in the event of relatively extreme bowing by providing a downwardly deflectable spring member 100, by providing spring contact terminals 48 having two points of contact 92 and 94 which are disposed at different elevations within the connector cavity 42 and by providing a double sided edge card 18. In accordance with this arrangement it is extremely unlikely that one or the other of contacts 92 and 94 would not make good electrical contact with at least one of the corresponding contact pads 30 on edge card 18. For this reason, the aforementioned redundancy is present throughout connector arrangement 10 provided enhanced electrical reliability.

In mated position, edge card 18 downwardly deflects spring member 100 over a portion of its vertical deflection range. Edge card 18 is rotated until mating apertures 34 and 36 engage mounting projections 58 and 60 and snap into final position past resilient latches 68 and 70. In mated position, upwardly biased but downwardly deflected spring member 100 exerts an upward force on cutout 32 so that the lower surfaces defined by apertures 34 and 36 push upwardly against the underside surfaces on mounting projections 58 and 60. This action provides biased positive vertical positioning of edge card 18 in connector 14 and limits vertical displacement of the edge card caused by vibrations or the like.

As can be appreciated, connector housing 40 is an extremely complicated molded part. The provision of a plurality of compartments 46 disposed to permit the terminals to be mounted at an ultra-low pitch is difficult in and of itself, but other important considerations are involved. More particularly, spring member 100 must be substantially rigid in a horizontal direction to limit lateral displacements of mating edge 28 within cavity 42. The upstanding mounting posts 54, 56 and projections 58, 60 must be sufficiently rigid to accurately cooperate with the pitch-controlling contact locator means 16 to accurately position edge card 18 for mating with connector 14. At the same time, however, housing 40 must also exhibit substantial resilience to permit downward deflection of spring member 100 and also manipulability for upstanding latch posts 64 and 66 together with latch projections 68 and 70. Furthermore, connector housing 40 must be molded from a material which exhibits excellent post-mold stability and especially warp resistance, even after repeated thermal cycling and upon exposure to high temperatures encountered in wave soldering operations.

After careful study it has now been discovered that well suited dielectric materials for use in molding the ultra-low pitch connector housing 40 are dielectric thermoplastic polymer resins or materials exhibiting a high enough UL Temperature Index to withstand the processing temperatures of the extrusion, molding and wave-soldering operations required to form the connector 14 and sufficient retained % Elongation after this demanding thermal history to provide proper resilient characteristics to spring member 100 and latch members 68 and 70.

In this connection, the thermoplastic dielectric material generally has a UL Temperature Index of above about 140 degrees C. and a % Elongation of above about 3.0%, particularly after repeated thermal cycling to such temperatures. Preferably, the dielectric material will have a UL Temperature Index of above about 180 degrees C. and a % elongation above about 5.0%.

Generally speaking, convention linear or branched thermoplastic polyesters frequently employed in molding connector housings and parts, such as for example poly(ethylene terphthalate) (PET) and poly(butylene terephthalate) (PBT) as well as resin blends based on these resins, exhibit good % Elongation properties but undesirably low UL Temperature Index values. Parts molded from these conventional materials therefore generally do not exhibit the warp resistance needed for the ultra-low pitch applications intended herein. The polyesters also tend to exhibit high post-mold shrinkage rendering them unsuitable in this context.

Other conventional resins employed as dielectric polymeric molding compositions for connectors include high temperature thermosetting resins such as poly(phenyl sulfones), epoxies, phenolics and poly(diallyl phthalates). These high temperature resins possess good UL Temperature Index ratings but undesirably low % Elongation values which are about only 1% or less, rendering these resins unsuitable as well.

Some resins which have been identified as suitable for use in molding ultra-low pitch connector housing 40 of this invention include poly(ether sulfones), poly(etherimides) poly(aryl sulfones) and poly(sulfones). Other resins exhibiting a UL Temperature Index of between 100 degrees C. and 200 degrees C. or higher and a % Elongation of between about 1% to about 20% or higher are considered potentially suitable for use herein.

Figure 8A:
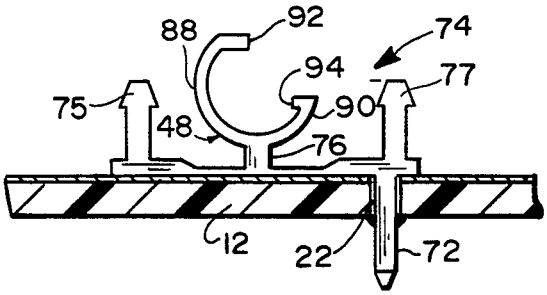
FIGS. 8*a* through 8*c* are side elevational views illustrating illustrative terminal contacts for use in the new and improved connector arrangement of this invention.
Figure 8B:
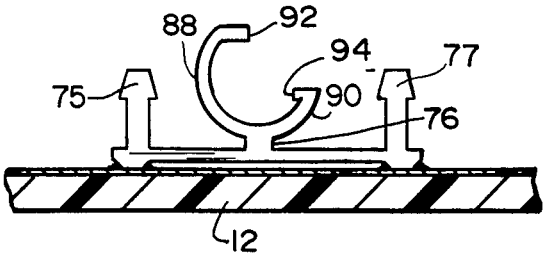
Figure 8C:
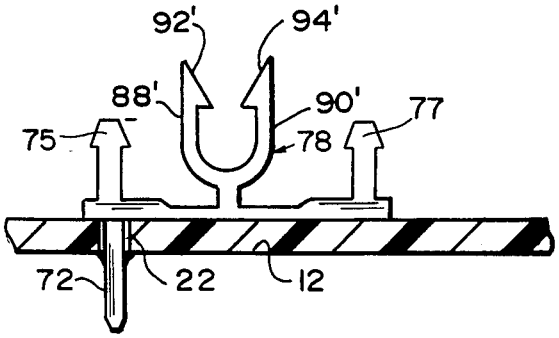

Although the present invention has been described with reference to certain preferred embodiments obvious variations will suggest themselves to those skilled in this art. For example, instead of providing solder tail terminals adapted to make solder tail connections with the through holes in the mother board, surface mount terminals such as shown in FIG. 8B adapted to engage contact pads on the mother board may be used.

Moreover, if the number of circuits for the ultra-low pitch connection in a given application is high necessitating the use of a long terminal array, the arrangement can be provided with more than one pitch-controlling contact locator means 16 including a plurality of spring members 100 and a corresponding number of mating cutouts in the edge card, to divide the array into several smaller arrays to obtain the pitch controlling advantages as taught herein.

Many of the structural features contributing to improved centerline-to-centerline mating of terminal-to-circuits provided by the ultra-low pitch connector arrangement of this invention may also be advantageously used in more conventional pitch, i.e. 0.100 inch connector arrangements to provide improved accuracy and enhanced reliability to these electrical connections, as well.

All such obvious modifications or changes may be made herein by those skilled in this art without departing from the scope and spirit of the present invention as defined by the appended claims.

We claim:

1. In an arrangement for electrically connecting closely-spaced circuit elements disposed on two printed circuit boards, said arrangement including:

a first printed circuit board; and a second printed circuit board having a mating edge and a surface with a linear array of aligned contact pads adjacent said edge;

a connector including an elongated dielectric housing with a cavity formed along its length with an opening for receiving said second printed circuit board mating edge and a plurality of terminals mounted in the housing to form a closelyspaced linear terminal array, each terminal adapted to engage a contact pad when the second printed circuit board is inserted into the cavity through said opening; and means for mounting the connector to said first printed circuit board;

the improvement comprising:

a pitch-controlling contact locator means cooperating between said mating edge and said connector, said contact locator means including:

a resilient supported spring member disposed in said connector cavity generally at the midpoint of said terminal array, said spring member being resilient in a vertical direction and substantially rigid in a horizontal direction; and a mating cutout disposed in said mating edge generally at the midpoint of the array of contact pads and adapted to engage said spring member with two points of contact when the second printed circuit board is inserted into said cavity;

whereby a connector arrangement exhibiting corrective compliance for circuit to terminal mating misalignments introduced by dimensional tolerances and board warpage is provided.

2. The arrangement defined in claim 1, wherein said dielectric housing and supported spring member comprise a unitary, integral dielectric molding.

3. The arrangement defined in claim 1, wherein said supported spring member comprises an H-spring member.

4. The arrangement defined in claim 2, wherein said molding comprises a dielectric material having a UL Temperature Index above about 100 degrees C. and a % Elongation above about 1.0%.

5. The arrangement defined in claim 2, wherein the molding comprises a dielectric material having a UL Temperature Index above about 140 degrees C. and a % Elongation above about 3.0%.

6. The arrangement defined in claim 2, wherein said molding comprises a dielectric material having a UL Temperature Index above about 180 degrees C. and a % Elongation above about 5.0%.

7. The arrangement defined in claim 2, wherein said molding comprises a dielectric material selected from the group consisting of poly(ethersulfones), poly(etherimides), poly(aryl sulfones) and poly(sulfones).

8. The arrangement defined in claim 1, wherein said mating cutout comprises a semi-circular cutout.

9. The arrangement defined in claim 1 further comprising means for retaining said second printed board in mating electrical engagement with the connector terminals.

10. A method for providing improved centerline mating between terminals and contact pads in a high density edge card connector arrangement including a linear array of closely-spaced terminals in a connector housing adapted to mate with a corresponding linear array of closely-spaced contact pads disposed on a surface of an edge card adjacent a mating edge, said method comprising:

(a) providing a pitch-controlling, contact locator generally at the midpoint of said linear terminal array, said contact locator comprising a resilient supported spring member being resilient in a vertical direction and substantially rigid in a horizontal direction;

(b) providing a mating cutout in the mating edge generally at the midpoint of the array of contact pads, said cutout being adapted to engage said spring member with two points of contact;

(c) positioning the edge card in said connector so that the mating cutout engages said spring member with two points of contact and said contact pads electrically engage said terminals; and (d) retaining said edge card in mating engagement with said connector, whereby substantially compliant, reliable ultra-low pitch edge card connector is provided.

* * * * *